US007445425B2

(12) United States Patent
Ferra et al.

(10) Patent No.: US 7,445,425 B2
(45) Date of Patent: Nov. 4, 2008

(54) SEAL ASSEMBLY

(75) Inventors: Paul William Ferra, Derby (GB); Timothy John Scanlon, Derby (GB)

(73) Assignee: Rolls-Royce plc, London (GB)

( * ) Notice: Subject to any disclaimer, the term of this patent is extended or adjusted under 35 U.S.C. 154(b) by 604 days.

(21) Appl. No.: 11/070,006

(22) Filed: Mar. 3, 2005

(65) Prior Publication Data

US 2005/0249588 A1 Nov. 10, 2005

(30) Foreign Application Priority Data

Mar. 31, 2004 (GB) ..... 0407279.9

(51) Int. Cl.
*F01D 5/00* (2006.01)

(52) U.S. Cl. ..... 415/134; 415/136; 415/137; 415/138; 415/139

(58) Field of Classification Search ..... 415/134, 415/136, 137, 138, 139
See application file for complete search history.

(56) References Cited

U.S. PATENT DOCUMENTS 3,970,318 A * 7/1976 Tuley ..... 415/139
4,688,988 A * 8/1987 Olsen ..... 415/116
5,167,485 A * 12/1992 Starkweather ..... 415/138
5,531,457 A * 7/1996 Tibbott et al. ..... 415/139
5,997,247 A 12/1999 Arraitz et al.
6,439,844 B1 * 8/2002 Turnquist et al. ..... 416/191

FOREIGN PATENT DOCUMENTS

GB 1047208 A 11/1966
JP A 10-274003 10/1998
JP A 2003-129803 5/2003

* cited by examiner

*Primary Examiner*—Igor Kershteyn
(74) *Attorney, Agent, or Firm*—Oliff & Berridge, PLC

(57) ABSTRACT

A seal arrangement 32 between a turbine shroud seal segments 38,40 in a gas turbine engine. The arrangement 32 comprises facing slots 34, 36 provided respectively in the segments 38,40 with offset spaces 42, 44 provided between the segments 38,40. A strip 46 is cemented into the slot 36 such that the flow path 50 passes through the space 42, around the free end of the strip 46, and out through the offset space 44, thereby providing a longer flow path.

13 Claims, 3 Drawing Sheets

SEAL ASSEMBLY

This invention concerns a seal assembly between components in a gas turbine engine, particularly but not exclusively such an assembly between respective components of a segmented annular assembly, and especially a seal assembly between turbine shroud seal segments, or nozzle guide vanes.

BACKGROUND

In gas turbine engines a seal is required in the circumferential gap between turbine shroud seal segments, and between nozzle guide vanes. A problem encountered on existing engines is the parasitic leakage of cooling and sealing air into the turbine annulus of a gas turbine. This can represent a significant performance loss to the engine through the air not doing useful work in the upstream turbine blade rows, and spoiling the aerodynamics of the blade rows immediately downstream.

SUMMARY

According to the present invention there is provided a seal assembly between coaxial components in a gas turbine engine, which assembly permits limited relative movement between the components, the assembly including cooperable formations on each component which together define a slot extending between and into each of the components, with respective spaces between the components on either side of the slot, a baffle member extending into the slot from a one of the components such that the fluid flow path between the components extends through a one of said spaces, into the slot, around the free end of the baffle member, and out through the other of said spaces, such that the fluid flow path is longer than the distance through said one space, around the free end of the baffle member, and out through a further space opposite said one space.

The components may comprise respective components of a segmented annular assembly.

The components may comprise turbine shroud seal segments, or nozzle guide vanes.

The spaces between the components may be radially offset relative to each other.

The baffle member may comprise a separate element, and may be bonded to the respective one component. The bonding may be provided by a material, which material may substantially fill the cooperable formation in said one component. The material may comprise a cement. The separate element may comprise a strip of material and preferably of metal.

Alternatively, the baffle member may be integrally formed with a one of the components.

The slots may be profiled across the components, with the baffle members having a corresponding profile.

A plurality of baffle members may be provided, with adjacent baffle members extending respectively from different components.

BRIEF DESCRIPTION OF THE DRAWINGS

Embodiments of the present invention will now be described by way of example only with reference to the accompanying drawings, in which.

DETAILED DESCRIPTION

Figure 1:
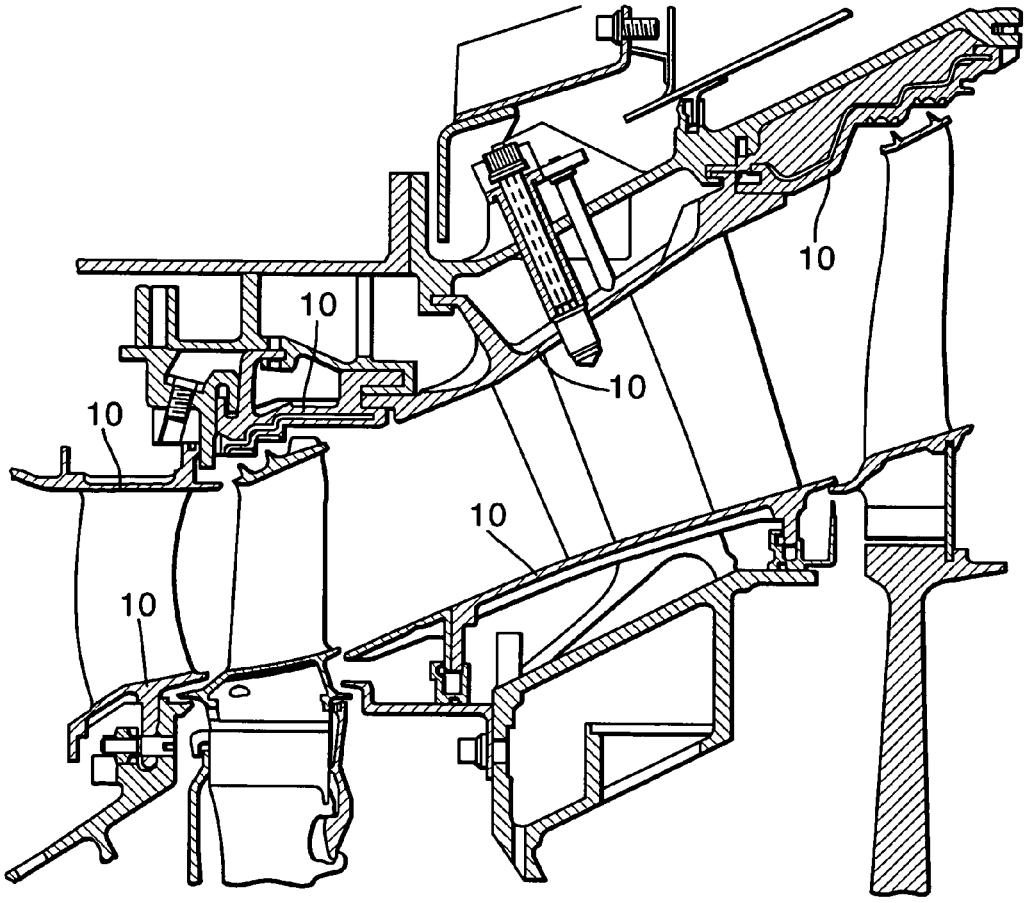
FIG. 1 is a diagrammatic sectional view through part of a turbine of a gas turbine engine.
Figure 2:
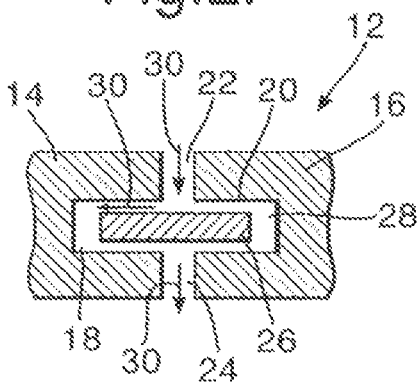
FIG. 2 is a diagrammatic sectional view through an existing seal assembly.

FIG. 1 shows part of a turbine of a gas turbine engine, and there is illustrated at 10 the location of a plurality of seals between either turbine shroud segments, or nozzle guide vanes. FIG. 2 shows a conventional seal arrangement 12 between two turbine shroud seal segments 14, 16. The arrangement 12 comprises symmetrical arrangements on each of the segments 14,16, comprising radially aligned slots 18, 20 respectively in the segments 14,16 which face each other, with aligned spaces 22, 24 between the segments 14,16 on either side of the slots 18, 20. A baffle member in the form of a metal strip 26 is mounted at one end in the slot 20 by cement 28 so as to extend into the slot 18 towards the closed end thereof, but leaving a sufficient space to allow for differential thermal expansion and other limited movement which may occur. The cement 28 closes off the slot 20. The gas flow path through the arrangement 12 is shown by the arrows 30 and passes through the space 22, around the free end of the strip 26 and out through the space 24.

Figure 3:
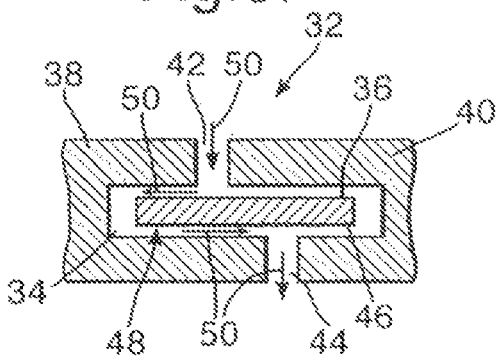
Related Art Fig.3.
FIGS. 3-5 are respectively similar views to FIG. 2 but of first, second and third seal assemblies according to the invention.
Figure 6:
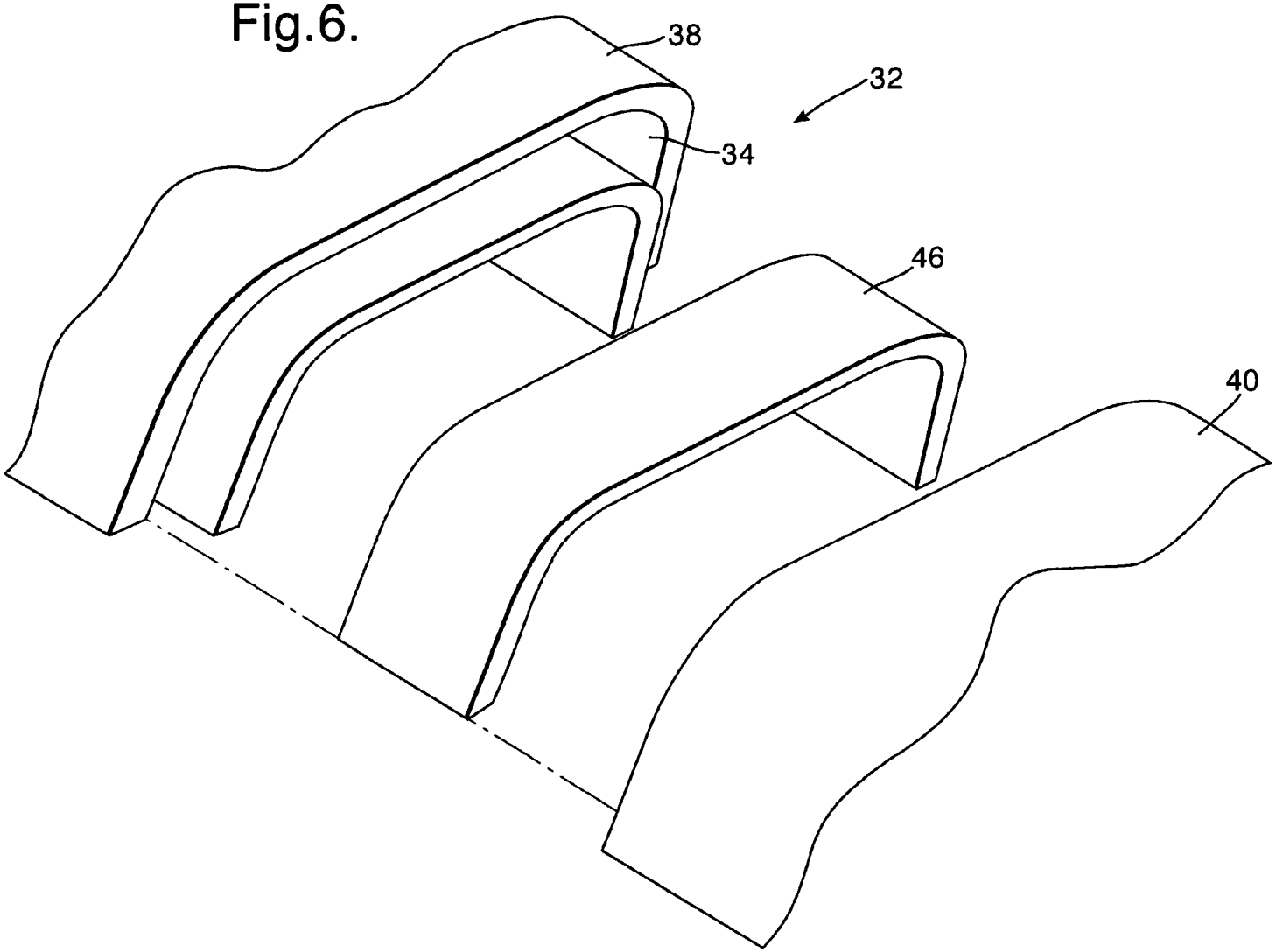
FIG. 6 is a diagrammatic exploded perspective view of the seal assembly of FIG. 3.

FIGS. 3 and 6 shows a seal arrangement 32 where again radially aligned slots 34, 36 are provided respectively in two turbine shroud seal segments 38, 40. The circumferential faces of the segments 38,40 are offset either side of the slots 34, 36 in a mirror image arrangement such that substantially equal sized spaces 42, 44 are provided respectively between the segments 38,40, but the spaces 42, 44 are offset relative to each other, with the slot 44 to the right of slot 42 as shown in the drawing.

A strip 46 which is longer than the strip 26, is located in the overall longer slot 48 formed by the slots 34, 36, and is cemented into the slot 36. This provides a longer flow path shown by arrows 50, than that provided in the arrangement 12. The engagement over the strip 46 on one side is the same as that in the arrangement 12 but is greater on the other side. FIG. 6 illustrates that the segments 38, 40 and hence slots 34, 36 have a generally n-shaped cross section. The strip 46 has a similar n-shaped cross section.

If a plurality of such arrangements 32 were provided, it may be necessary to include one conventional arrangement such as the arrangement 12, to enable the ring of seal segments to be assembled. With the arrangements 32 it may be possible to have an increase in clearance around the strip 46 due to the increase in flow path and hence frictional length, therearound.

Figure 4:
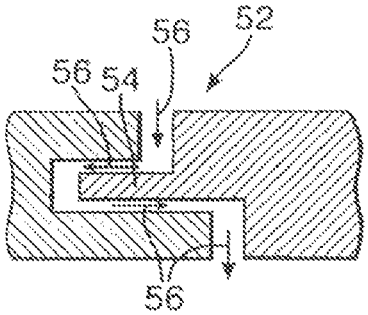

FIG. 4 shows a seal arrangement 52 which in most respects is similar to the seal arrangement 32 and only the differences will therefore be described in any detail. Rather than providing a separate strip, the baffle member is provided by a rectangular section projection 54 on the seal segment. This provides a flow path shown by arrows 56 which is similar to that shown by the arrows 50. Removing the requirement to use a cement, reduces the build times involved.

Figure 5:
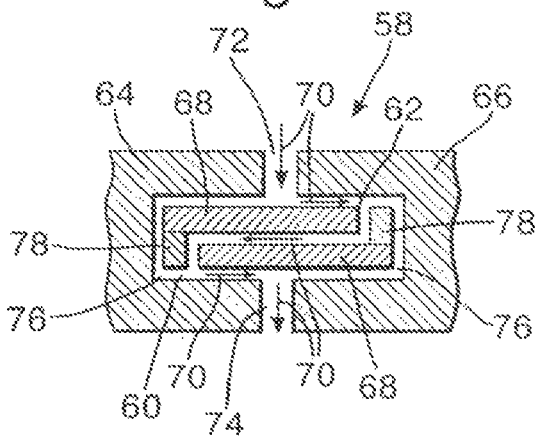

FIG. 5 shows a further seal arrangement 58, between two nozzle guide vanes 64, 66. Wider radially aligned slots 60, 62 are provided respectively in the nozzle guide vanes 64,66. Two metal strips 68 are mounted, one in each of the slots 60, 62, such that the flow path shown by arrows 70 passes through a first circumferential space 72 between the vanes 64,66, around a free end of the strip 68 mounted to the vane 64, the path then passes between the two strips 68, around the free end of the strip 68 mounted to the vane 66 and out through the other space 74 which is circumferentially aligned with the space 72.

This arrangement 58 provides for a considerably longer flow path than those described above. The strips 68 are mounted respectively to the vanes 64.66 by cement 76, and a plurality of discrete tangs 78 are provided on the mounting end of the strip 68 to ensure that it is a tang 78 which is mounted respectively to the vanes 64,66, rather than the free end of the other strip 68.

There are thus described a number of seal arrangements according to the invention which provide for significant advantages in providing an elongate flow path. Each of the seal arrangements is of relatively straightforward construction and can thus be inexpensively manufactured without any significant extra construction steps.

Various modifications may be made without departing from the scope of the invention. For instance, it may not always be necessary for the strips to be mounted by cement. Such arrangements may be used to provide seals between other components, and particularly other segmented annular assemblies in a gas turbine engine.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A seal assembly between components in a gas turbine engine, which assembly permits limited relative movement between the components, the assembly including cooperable formations on each component which together define a slot extending between and into each of the components, with respective spaces between the components on either side of the slot, a baffle member extending into the slot from one of the components such that the fluid flow path between the components extends through one of said spaces, into the slot, around the free end of the baffle member, and out through the other of said spaces, such that the fluid flow path is longer than the distance through said one space, around the free end of the baffle member, and out through a further space opposite said one space, each of said one space and the further space opposite said one space having a central longitudinal axis, the central longitudinal axis of each of said spaces being substantially parallel, and laterally offset, relative to the other.

2. An assembly according to claim 1, wherein the components comprise respective components of a segmented annular assembly.

3. An assembly according to claim 2, wherein the components comprise a turbine shroud seal segments.

4. An assembly according to claim 2, wherein the components comprise nozzle guide vanes.

5. An assembly according to claim 1, wherein the spaces between the components are radially offset relative to each other.

6. An assembly according to claim 1, wherein the baffle member comprises a separate element.

7. An assembly according to claim 6, wherein the baffle member is bonded to the respective one component.

8. An assembly according to claim 7, wherein the bonding is provided by a material, which material substantially fills the cooperable formation in said one component.

9. An assembly according to claim 6, wherein the separate element comprises a strip of material.

10. An assembly according to claim 1, wherein the baffle member is integrally formed with one of the components.

11. An assembly according to claim 1, wherein the slots are profiled across the components, with the baffle members having a corresponding profile.

12. An assembly according to claim 1, wherein a plurality of baffle members are provided, with adjacent baffle members extending respectively from different components.

13. An assembly according to claim 9, wherein the strip of material is metal.

* * * * *